US011794316B2

(12) United States Patent
Beguin

(10) Patent No.: US 11,794,316 B2
(45) Date of Patent: Oct. 24, 2023

(54) IMPACT WRENCH WITH IMPACT MECHANISM

(71) Applicant: ETABLISSEMENTS GEORGES RENAULT, Saint Herblain (FR)

(72) Inventor: Remi Beguin, Nantes (FR)

(73) Assignee: ETABLISSEMENTS GEORGES RENAULT, Saint Herblain (FR)

( * ) Notice: Subject to any disclaimer, the term of this patent is extended or adjusted under 35 U.S.C. 154(b) by 160 days.

(21) Appl. No.: 17/130,620

(22) Filed: Dec. 22, 2020

(65) Prior Publication Data

US 2021/0187708 A1 Jun. 24, 2021

(30) Foreign Application Priority Data

Dec. 24, 2019 (FR) ..... 1915581

(51) Int. Cl.
*B25B 21/02* (2006.01)
*B25B 23/147* (2006.01)

(52) U.S. Cl.
CPC ..... *B25B 21/026* (2013.01); *B25B 23/1475* (2013.01)

(58) Field of Classification Search
CPC ..... B25B 19/00; B25B 21/02; B25B 21/026; B25B 23/1453; B25B 23/1475
See application file for complete search history.

(56) References Cited

U.S. PATENT DOCUMENTS 2,285,638 A * 6/1942 Amtsberg ..... F16D 5/00 173/93.5
2,663,395 A * 12/1953 Schmid ..... F16D 5/00 173/93.5
3,661,217 A * 5/1972 Maurer ..... B25B 21/026 173/93.5
4,287,956 A * 9/1981 Maurer ..... B25B 21/026 173/93.5
4,321,973 A * 3/1982 Maurer ..... B25B 21/026 173/93.5

(Continued)

OTHER PUBLICATIONS

French Search Report and English Translation of Written Opinion dated Sep. 4, 2020 for corresponding French Application No. 1915581, filed Dec. 24, 2019.

(Continued)

*Primary Examiner* — Thomas M Wittenschlaeger
*Assistant Examiner* — David G Shutty
(74) *Attorney, Agent, or Firm* — David D. Brush; Westman, Champlin & Koehler, P.A.

(57) ABSTRACT

A screw driving tool including: a motor; an impact mechanism driven by the motor along a rotational axis and held fixed in translation along the rotational axis. the impact mechanism has: a striker system with a striker element, a square drive including at least one strike reception element, the striker element being configured to come into contact with the at least one strike reception element to generate an impact torque, the striker system being configured to be driven in rotation, along the rotational axis, on at least 200° before impact. The impact mechanism has an anti-vibrational element configured so that, during an impact: the center of gravity of the impact mechanism is appreciably positioned on the rotational axis, and the rotational axis of the impact mechanism is appreciably on its main axes of inertia.

9 Claims, 7 Drawing Sheets

(56) References Cited

U.S. PATENT DOCUMENTS 5,906,244 A * 5/1999 Thompson ..... B25B 21/026 173/93.5
6,782,956 B1 * 8/2004 Seith ..... B25B 21/026 173/206
9,539,715 B2 * 1/2017 McClung ..... B25B 21/026
9,616,558 B2 * 4/2017 Nishikawa ..... B25B 23/1475
2003/0024714 A1 * 2/2003 Liao ..... B25B 21/026 173/93.5
2008/0073094 A1 * 3/2008 Lu ..... B25B 21/026 173/104
2013/0161045 A1 * 6/2013 Ting ..... B25D 17/06 173/94
2013/0264087 A1 * 10/2013 Harada ..... B25B 21/02 173/213
2014/0069674 A1 * 3/2014 Tsai ..... B25B 21/026 173/93
2015/0114674 A1 * 4/2015 Ho ..... B25B 19/00 173/93.6
2015/0122525 A1 * 5/2015 Wei ..... B25B 23/1405 173/179
2015/0190909 A1 * 7/2015 Ely ..... B25B 21/02 81/177.85
2015/0343616 A1 * 12/2015 Chen ..... F16J 15/16 173/93
2016/0214238 A1 * 7/2016 Sun ..... B25B 21/02
2019/0375078 A1 * 12/2019 Chen ..... B25F 5/006
2021/0187708 A1 * 6/2021 Beguin ..... B25B 23/1475

OTHER PUBLICATIONS

Machine English translation of European Action dated Oct. 17, 2022, for corresponding EP Application No. 20214371.5.
English Translation of French Written Opinion dated Sep. 4, 2020 for corresponding French Application No. 1915581, filed Dec. 24, 2019.

* cited by examiner

IMPACT WRENCH WITH IMPACT MECHANISM

1. TECHNICAL FIELD

The field of the invention is that of the designing and manufacture of devices for screwing/unscrewing (or tightening/untightening) by impact.

The invention relates especially but not exclusively to impact wrenches and more particularly to impact wrenches with impact mechanism.

2. PRIOR ART

Impact screwing/unscrewing devices such as impact wrenches are commonly used in various fields, especially in motor vehicle garages and for industrial maintenance.

These tools are used chiefly for the dismantling of mechanical components on vehicles or on machines. They can also be used for mounting and remounting certain components.

The components, which are tightened or loosened by the use of the impact wrench, are varyingly clean and/or oxidized.

In addition, the spaces of intervention can be confined, difficult to access and encumbered by other potentially injurious and poorly lit components.

Impact wrench users therefore expect their tools to help limit the impact of the difficulties mentioned above.

Thus, to reduce the difficulties related to using impact wrenches in confined and encumbered spaces, users wish to use compact tools.

More generally, the impact wrench users have expectations especially in terms of ergonomy, efficiency and durability In terms of ergonomy, users seek noiseless, lightweight tools that entail only low levels of vibration.

In terms of efficiency, the users wish to be able to carry out swift tightening/loosening operations with an appropriate level of quality (tightening to the desired torque value) while benefiting from high visibility in the intervention area.

In terms of durability, users wish to have solid tools that are especially shock-resistant and capable of working well over time.

Existing impact wrenches include especially pneumatic impact wrenches with rebound impact mechanism and electrical impact wrenches with rebound impact mechanism.

The patent documents U.S. Pat. Nos. 3,661,217 and 4,287,956 describe examples of pneumatic impact wrenches with rebound impact mechanism.

Whether these impact wrenches with rebound mechanism are pneumatic or electric, they generally comprise a (pneumatic or electric) motor provided with a rotor and a stator, an impact mechanism driven by the rotor of the motor and a square drive, also called an output shaft, capable of cooperating with a component to be tightened/loosened.

The impact mechanism comprises a striking system comprising especially a striker, for example a hammer element, driven in rotation by the stator and capable of coming into collision with the square drive to generate impacts.

To perform an impact screwing/unscrewing operation, the striker or hammer system is driven by the motor. During this rotation, the striker element is made to come into collision with the square drive. At each collision, the impact mechanism transmits, in an impact, a torque to the square drive that rotationally drives the element to be screwed/unscrewed.

At each impact in the impact mechanism, the kinematic chain between the motor and the square drive gets deformed and thus accumulates potential energy. This potential energy is restored during the relaxation of the kinematic chain, inducing a rebound of the impact mechanism in reverse to the working direction, i.e., in reverse to the sense of the screwing/unscrewing operation.

During this rebound, the rotor of the motor rotates in reverse to the sense for which the motor is powered. Then, the motor is re-accelerated in the sense of the screwing/unscrewing operation so as to make the impact mechanism again transmit a torque to the square drive. The cycles get thus repeated to perform the screwing/unscrewing operation up to its end.

In other words, the working of an impact wrench with rebound impact mechanism can be sub-divided into three phases, namely:

- a phase of rotation in which the motor, the impact mechanism and the square drive are driven by rotation by a low torque: this is the case when a member to be screwed/unscrewed is subjected to a low external resistance (that can especially arise when approaching and removing the member to be screwed/unscrewed);
- a phase of acceleration situated between two impact phases, in which the motor and the impact mechanism re-accelerate so long as the square drive is kept immobile owing to the external resistance to which the member to be screwed/unscrewed is subjected; and
- an impact phase in which the motor, the impact mechanism and the square drive work with great variations in speed (due to the rendering of the accumulated kinetic energy) that moves the member that is to be screwed/unscrewed.

FIG. 9 schematically represents the layout of the motor, the impact mechanism and the square drive of an impact wrench with rebound impact mechanism The impact wrench 1000, disposed in an X, Y, Z referential system, comprises a pack 1001, also called a casing, within which there is disposed a mechanical system composed of a (pneumatic or electric) motor 1002 and an impact mechanism 1003 driven by this motor 1002. The mechanical system is mobile in rotation relatively to the casing 1001. More specifically, this mechanical system is coupled to the casing 1001 by pivot links, formed by bearings $\mathbf{1001}_1$, $\mathbf{1001}_2$, $\mathbf{1001}_3$, enabling this assembly to be mobile in rotation along the rotational axis AR oriented along the Z axis of the referential system. The impact mechanism 1003 furthermore carries a square drive 1004 oriented along the rotational axis AR.

In addition, during use, the motor 1002 generates efforts on the casing 1001, corresponding to the motor torque, symbolized by the spring 1005.

It can be seen therefore that, during the use of the impact wrench, the vibrations perceived by the user come, on the one hand, from the variations in motor torque and, on the other hand, from the efforts generated by the mechanical system, constituted by the motor 1002 and the impact mechanism 1003, as a whole, at the level of the bearings $\mathbf{1001}_1$, $\mathbf{1001}_2$, $\mathbf{1001}_3$.

More specifically, FIG. 10, which is a schematic representation of the mechanical system, theoretically illustrates, for reasons of clarity, the distribution of the efforts of the mechanical system on a bearing of the casing during a phase of impact. Naturally, in the presence of a plurality of bearing surfaces, the efforts of the mechanical system are distributed over all the bearing surfaces.

As illustrated, during the impact phase, the mechanical system is subjected to:

- a torque $\vec{C}$ of the motor 1002 oriented along the rotational axis AR of the mechanical system oriented along the axis $\vec{Z}$;
- a torque $\vec{T}$ coming from the resistance induced by the member to be screwed/unscrewed. The torque values $\vec{C}$ and $\vec{T}$ have identical directions and opposite sensors;
- a reaction force $\vec{F}$ on the bearing surface $\mathbf{1001}_2$ of the casing 1000; and
- a moment $\vec{M}$ on the bearing surface $\mathbf{1001}_2$ of the casing 1000.

Again, in the phase of impact, a moment of rotation appears around the axis of the bearing surface $\mathbf{1001}_2$, with angular speed $\omega\vec{Z}$ and angular acceleration $$\frac{d\omega}{dt}\vec{Z}.$$

The mechanical system furthermore possesses:

- a mass m;
- a center of gravity G with acceleration $\vec{a}_G$; and
- an inertia matrix [J] computed at the center of gravity G and in the Galilean referential system ($\vec{X}$, $\vec{Y}$, $\vec{G}$), presented as follows:

$$[J]_{(GMechanical\ syrzm)} = \begin{bmatrix} J_{xx} & J_{xy} & J_{xz} \\ J_{xy} & J_{yy} & J_{yz} \\ J_{xz} & J_{yz} & J_{zz} \end{bmatrix}_{(\vec{X},\vec{Y},\vec{Z})}$$

It is important to note that this theoretical representation and the associated discussion consider only the external efforts generated by the impact mechanism. The efforts internal to the impact mechanism, such as the effort coming from the striker system, are not shown.

These impact wrenches with impact mechanism include various known impact mechanisms, especially:

- Maurer type single-hammer, jumbo hammer, one hammer, single dog impact mechanisms;
- Maurer type twin-hammer, twin-lobe or double-dog impact mechanisms;
- Two-jaws mechanisms;
- Pin-clutch mechanisms;
- Etc.

It has also been observed that certain afore-mentioned impact mechanisms cumulatively present the following technical characteristics:

- an impact mechanism fixed in the direction of the rotational axis of the square drive, corresponding to the axis of the bearing surfaces holding the mechanical system, integrating the motor and the impact mechanism within the casing; and
- an impact mechanism enabling an acceleration of the striker element on more than one half turn of the square drive before the impact, in doing so without even benefitting from the rebound of a prior strike.

It has been observed that the rebound impact mechanism of the Maurer type has these two cumulative technical characteristics.

This is why the structures of the Maurer type single-hammer and twin-hammer impact mechanisms shall be described in detail with reference to FIGS. 11 and 12 respectively.

FIGS. 11A to 11B are perspective (or three-quarter) and schematic views respectively of a Maurer type single-hammer rebound impact mechanism.

As illustrated in FIG. 11A, a Maurer type single-hammer rebound impact mechanism 1100 comprises a cage 1101 to be driven rotationally by a motor, a hammer 1102 disposed in the cage 1101 and driven in rotation by this cage by means of rods 1103.

Such an impact mechanism 1100 further comprises a square drive 1104 having a striker reception element $\mathbf{1104}_1$, also called an anvil, having a strike reception surface. The strike reception surface $\mathbf{1104}_1$ is intended to be situated facing a striker element 1102, also called a hammer, having a strike surface. The striker element 1102 is furthermore configured to be in sliding contact on the square drive 1104. Such a layout of the components of the impact mechanism 1100 enables the striker element 1102 to be brought into collision against the strike reception element $\mathbf{1104}_1$ once per turn of the striker element 1102.

During the phase of impact of a single-hammer rebound impact mechanism 1100, as illustrated schematically in FIG. 11B, it can be seen that the striker element 1102 and the strike reception element $\mathbf{1104}_1$ respectively have a center of gravity (represented by a cross) that is off-centered relatively to the square drive 1104. It has been observed that such an off-centering, during the impact phase especially, gives rise to a high level of vibrations perceived by the user.

FIGS. 12A and 12B are perspective and schematic views respectively of an impact wrench equipped with a Maurer type twin-hammer rebound impact mechanism.

As illustrated in FIG. 12A, a Maurer type twin-hammer rebound impact mechanism 1200 is distinguished from a Maurer type single-hammer rebound impact mechanism by the implementation, in the cage 1201, of two striker elements 1202A, 1202B that are diametrically opposite and off-centered relatively to each other, i.e., disposed on distinct planes. During a use of such a mechanism, the two striker elements 1202A, 1202B are driven in rotation symmetrically relatively to the square drive 1204.

Besides, during the phase of impact of a twin-hammer rebound impact mechanism 1200 as illustrated schematically in FIG. 12B, it is noted that the diametrically opposite disposition of the striker elements 1202A, 1202B enables the cage 1201 to have a center of gravity situated on the square drive 1204. It has been observed that such a configuration enables the twin-hammer rebound mechanism to reduce the level of vibrations perceived by the user but that this level nevertheless remains very high.

It is seen therefore that the prior-art techniques have various drawbacks, including one common drawback relatively to the high level of the vibrations perceived by the user.

Indeed, it can be seen that, because of the presence of known impact mechanisms, impact wrenches with rebound impact mechanism, whether of the pneumatic or electric type, give rise to a high level of vibrations perceived by the user.

Besides, it is known that such vibrations are harmful and present a risk for the user. Indeed, such vibrations can especially prompt illnesses such as musculoskeletal disorders (tendonitis), vascular disorders (secondary Raynaud's syndrome for example), disorders of the nervous system (loss of sensitivity and/or dexterity for example), etc.

There is therefore a need for technical solutions that at least partly mitigate the problems of the prior-art solutions.

3. SUMMARY OF THE INVENTION

All or part of these goals as well as others that shall appear clearly here below are obtained by means of a screwing/unscrewing tool comprising:

- a drive motor;
- an impact mechanism driven by said motor along a rotational axis and held fixed in translation along said rotational axis, said impact mechanism comprising:
- a striker system rotationally driven along said rotational axis, comprising at least one striker element,
- a square drive comprising at least one strike reception element,
- said at least one striker element being configured to come into contact with said at least one strike reception element to generate an impact torque,
- said striker system being configured to be driven in rotation, along said rotational axis, on at least 200° before impact,
- characterized in that the impact mechanism comprises anti-vibration means configured so that, at least during an impact:
- the center of gravity of the impact mechanism is appreciably positioned on said rotational axis, and
- said rotational axis of the impact mechanism is appreciably on its main axes of inertia.

The implementing of anti-vibration means with such a configuration makes it possible, for the impact mechanisms fixed in translation along their rotational axis and comprising a striker system giving rise to a maximum of one strike once per turn of the mechanism, to reduce or even eliminate, at least during the phase of impact, the level of vibrations perceived by the user, and to do so at lower cost. This therefore means a reduction of the risk of emergence of illnesses or discomfort caused by such vibrations and therefore an improvement of the comfort of use of the screwing/unscrewing tool.

According to one particular embodiment, said at least one striker element comprises a strike surface and said at least one strike reception element comprises a strike reception surface, and said at least one striker element is configured to alternate cyclically between:

- a disengaged position in which at least one striker element is not in contact with said at least one reception element, and
- an engaged position, in which said strike surface of said at least one striker element is in contact with said strike reception surface of said at least one strike reception element so as to generate said impact torque.

It can thus be seen that the anti-vibration means can be implemented in transversal engagement systems enabling, through the rebound, more than one acceleration turn between two impacts and therefore greater energy per impact, as can be the case especially in Maurer-type impact mechanisms.

According to another particular embodiment, said anti-vibration means are configured so that:

- the center of gravity of the impact mechanism is permanently situated appreciably on its rotational axis, and
- said rotational axis of the impact mechanism is permanently and appreciably one of its main axes of inertia.

In other words, this configuration enables the striker system to be also balanced dynamically during phases of acceleration situated between two successive impact phases, and rotational phases.

Thus, the anti-vibration means enable the reduction or even the elimination of the level of vibrations perceived by the user for all the phases of operation of the screwing/unscrewing tool and not solely during the phase of impact. This is expressed by a general improvement of the comfort and experience of use of such a screwing/unscrewing tool. The risk of the emergence of illnesses or discomfort caused by the vibrations is therefore further minimized.

According to another particular embodiment, said striker system comprises at least three striker elements having identical cross-sections in a plane essentially perpendicular to said rotational axis and said at least three striker elements constitute said anti-vibration means.

The term "cross-section" is understood to mean a section in a plane normal to the rotational axis of the impact mechanism.

The implementing of striker elements with identical cross-sections, i.e., radial sections along the rotational axis of the impact mechanism, minimizes or even eliminates the level of vibrations perceived by the user in a simplified way and at lower cost.

According to another particular embodiment, said striker system comprises the following, disposed along the rotational axis of said impact mechanism:

- a central striker element having, along the rotational axis of said impact mechanism, a total value of thickness, and
- two lateral striker elements disposed on either side of said at least one central striker element, along the rotational axis of the impact mechanism, the lateral striker elements having respectively values of thickness equal to half of the value of the total thickness of said at least one central striker element along said rotational axis,
- and said at least one central striker element is disposed so as to be diametrically opposite to said lateral striker elements relatively to the rotational axis of the impact mechanism.

According to another particular embodiment, said central striker element comprises at least two juxtaposed elementary central striker elements, the sum of the thicknesses along said axis of said elementary central striker elements being equal to said total value of thickness.

According to another particular embodiment, said anti-vibration means comprise at least one counterweight disposed in the impact mechanism, said at least one counterweight being configured to cancel out the efforts radial to said rotational axis induced by said at least one striker element and by said at least one strike reception element.

Such a counterweight constitutes a simple solution of implementation enabling the reduction or even the elimination, during the phase of impact, of the level of vibrations perceived by the user, in doing so at lower cost. In addition, such counterweights can be added on by appropriate affixing means to existing impact mechanisms.

According to another particular embodiment, said at least one counterweight is disposed in the impact mechanism, said at least one counterweight being positioned at 180°, along the rotational axis of the impact mechanism, to said at least one striker element and of said at least one strike reception element.

5. LIST OF FIGURES

Other features and advantages of the invention shall appear more clearly from the following description, given by way of a simple illustratory and non-exhaustive example and from the appended figures, of which:

6. DESCRIPTION

For the sake of clarity, the same elements have been designated by the same references in the different figures.

6.1. General Principle

As already indicated here above, there are known impact mechanism impact wrenches of an electric or pneumatic type implementing various types of impact mechanisms that give rise to high levels of vibrations perceived by the user.

Known types of impact mechanisms include mechanisms with the following technical characteristics:

- an impact mechanism fixed in the direction of the rotational axis of the square drive; and
- an impact mechanism enabling an acceleration of a striker element, a hammer for example, on more than one half-turn of the square drive before the impact.

The proposed technique (described in detail here below) is intended to be implemented in impact wrenches, the impact mechanism of which has two cumulative technical characteristics. In other words, these two technical characteristics constitute prerequisites for proposed technique.

In a trade-off for a non-obvious approach described in detail here below, the inventor of the present application has identified a novel and inventive technique making it possible, for the types of impact mechanisms meeting the above-mentioned prerequisites, to minimize or even eliminate the level of vibrations perceived by the user.

The general principle of the proposed technique consists in implementing an impact mechanism comprising anti-vibration means configured so that, during the impact:

- the center of gravity of the impact mechanism is appreciably positioned on its rotational axis, and
- the rotational axis of the impact mechanism is appreciably one of its main axes of inertia.

Such a configuration wholly or in part eliminates undesirable external efforts generated by the impact mechanism. This means a reduction, or even an elimination, of the level of vibrations perceived by the user during the operation of an impact wrench in accordance with the proposed technique.

6.2. Detail of the General Principle

Figure 10:
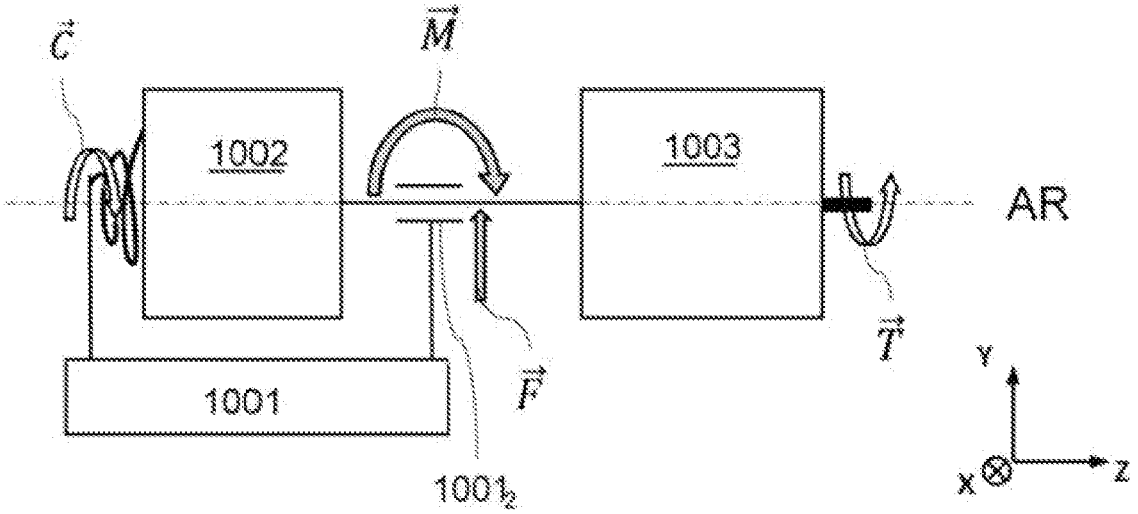
Fig. 10 (Prior Art)
FIG. 10 is a schematic representation of the distribution of the efforts of a mechanical system of a screwing/unscrewing device with impact mechanism according to the prior art.
Figure 11A:
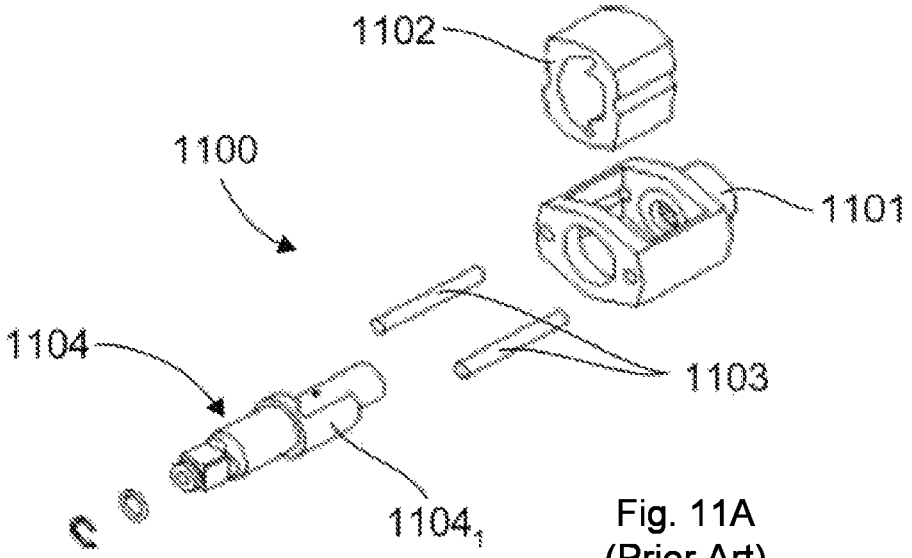
Fig. 11A (Prior Art)
FIGS. 11A and 11B are different illustrations of a Maurer single-hammer impact mechanism according to the prior art.
Figure 11B:
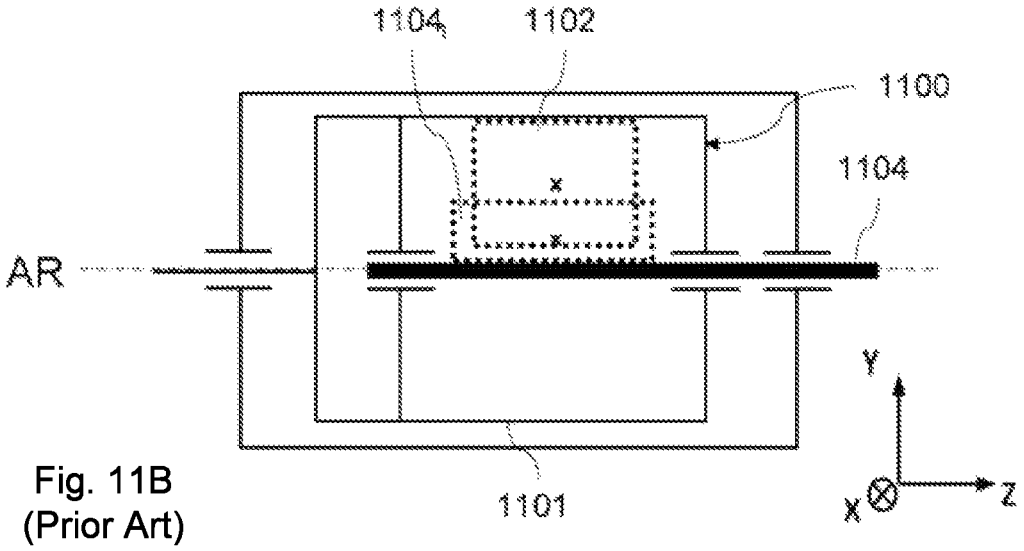
Fig. 11B (Prior Art)
Figure 12A:
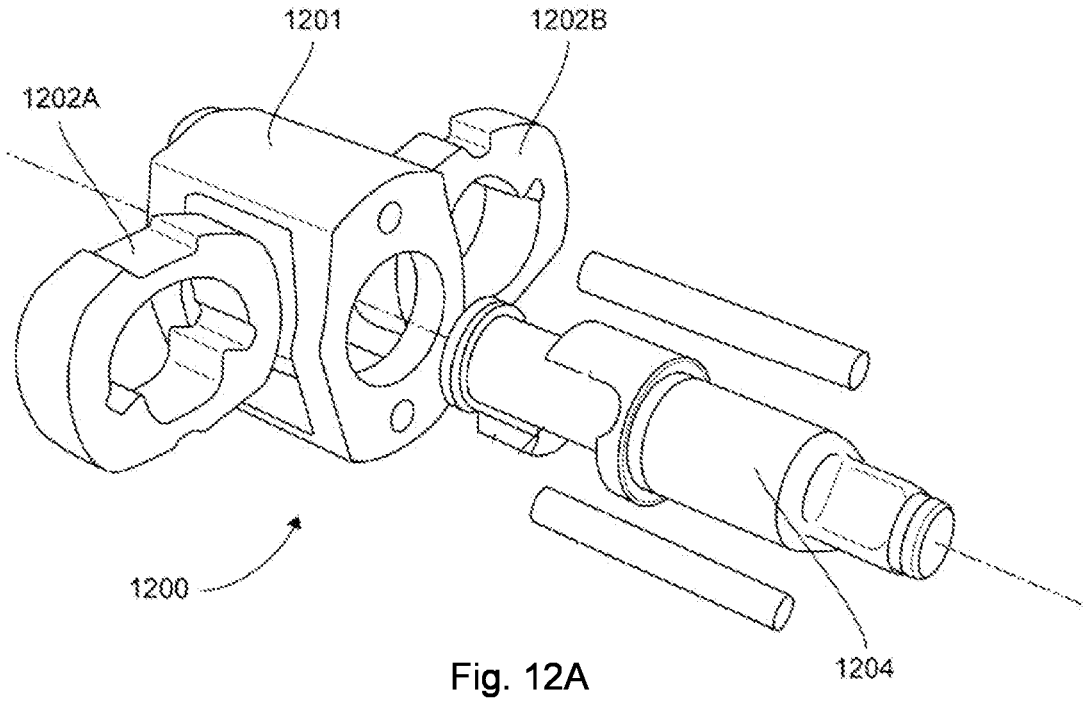
Fig. 12A (Prior Art)
FIGS. 12A and 12B are different illustrations of a Maurer twin-hammer impact mechanism according to the prior art.
Figure 12B:
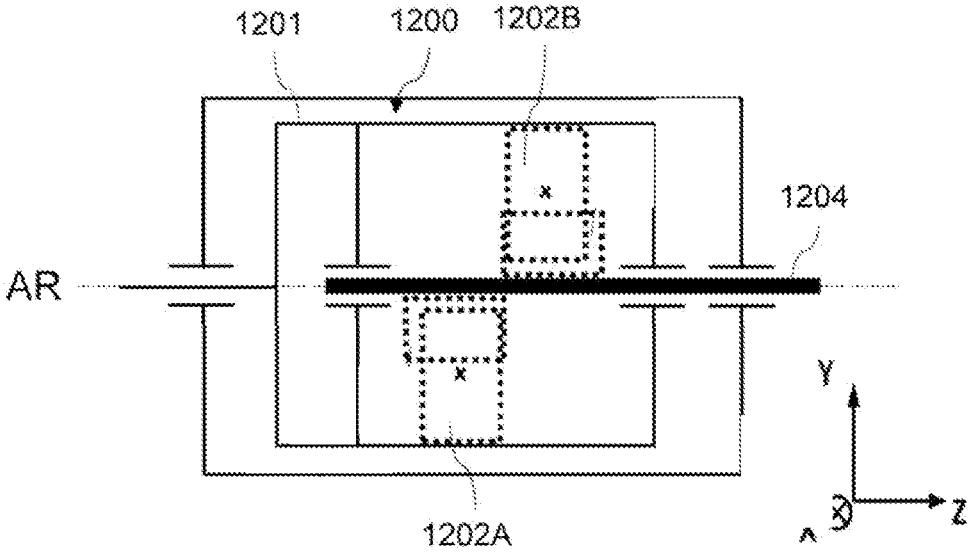
Fig. 12B (Prior Art)

With reference to the representation of efforts of the mechanical system on a bearing of the casing during a phase of impact, previously described with reference to FIG. 10, the inventor of the present invention has identified two cumulative criteria making it possible, when they are met, to minimize or even eliminate the level of vibrations perceived by the user.

First of all, the inventor of the present application has observed that the application of the fundamental principle of dynamics on a portion, namely a bearing surface, of the casing holding the mechanical system that incorporates the motor and the impact mechanism, makes it possible to obtain the following equation:

$$\vec{F}=m\cdot\vec{a}_G$$

with:

$\vec{F}$ corresponding to the force of reaction of a portion of the casing holding the mechanism system;

m corresponding to the mass of the same mechanical system; and $\vec{a}_G$ corresponding to the acceleration of the mechanical system at its center of gravity.

The inventor of the present application has therefore established that, through the positioning of the center of gravity G of the mechanical system on the rotational axis $\vec{Z}$, the acceleration $\vec{a}_G$ of the mechanical system at this point is zero when the impact takes place. This results in the elimination of the reaction force $\vec{F}$ and therefore in a reduction of the level of vibrations perceived by the user. This reasoning can be applied to each bearing holding the mechanical system.

Starting from this result, namely that the center of gravity G of the mechanical system is positioned on the rotational axis $\vec{Z}$, the inventor of the present invention has furthermore observed that the application of the kinetic moment theorem to the mechanical system makes it possible to obtain the following vector equation (1) at a center of gravity G and in a Galilean referential system (G, $\vec{X}$, $\vec{Y}$, $\vec{Z}$):

$$\vec{C}+\vec{M}+\vec{T}=[J]\frac{d\omega}{dt}\vec{Z} \tag{1}$$

with:

- $\vec{C}$ corresponding to the torque of the motor;
- $\vec{M}$ corresponding to the moment of the portion of the casing holding the mechanical system;

$\vec{T}$ corresponding to the resistive torque of the member to be screwed/unscrewed;

[J] corresponding to the inertia matrix of the mechanical system computed at the center of gravity G and in the fixed referential system ($\vec{X}$, $\vec{Y}$, $\vec{Z}$); and $$\frac{d\omega}{dt}\vec{Z}$$

corresponding to the angular acceleration of the mechanical system along the axis $\vec{Z}$.

The vector equation (1) is sub-divided into three scalar equations, distributed on the three axes of the referential system ($\vec{X}$, $\vec{Y}$, $\vec{Z}$), namely:

$$M_x = J_{xz}\frac{d\omega}{dt} \tag{2}$$

$$M_y = J_{yz}\frac{d\omega}{dt} \tag{3}$$

$$C + M_z - T = J_{zz}\frac{d\omega}{dt} \tag{4}$$

The inventor of the present application has observed that the portion $M_z$ of the moment of the portion of the casing holding the mechanical system $\vec{M}$ along the axis $\vec{Z}$ is low, because it corresponds to friction in the bearing and is therefore negligible.

The inventor of the present application has therefore established that to reduce, or even eliminate, the level of vibrations perceived by the user, the reactions $M_x$ and $M_y$, corresponding to the reactions of the moment $\vec{M}$ along the axes $\vec{X}$and $\vec{Y}$ respectively must be deduced or even eliminated.

More specifically, the inventor of the present application has therefore established that by defining, during the impact, the rotational axis $\vec{Z}$ as a principle of inertia of the system, the products of inertia $J_{xz}$ and $J_{yz}$, and therefore the associated reactions $M_x$ and $M_y$ are reduced, or even eliminated.

Finally, the inventor of the present application is observed that the rotors of the motors, whether electric or pneumatic, have appreciably a symmetry along their respective axes of revolution and therefore along the rotational axis $\vec{Z}$. Hence, the center of gravity of the rotor is initially positioned on or in proximity to the rotational axis $\vec{Z}$ which itself constitutes a main axis of inertia The inventor of the present application has therefore determined that to reduce or even eliminate the level of vibrations perceived by the user, it is appropriate that the impact mechanism should be configured so that, during the impact:

- its center of gravity G is positioned appreciably on its rotational axis $\vec{Z}$, and
- its rotational axis $\vec{Z}$ is appreciably one of the main axes of inertia.

The inventor of the present application has also observed that each component of the impact mechanism must meet these two criteria, namely the center of gravity of the impact mechanism must be positioned on the rotational axis of this mechanism and the rotational axis must be the main axis of inertia of the impact mechanism.

6.3. Description of a First Embodiment

Figure 1:
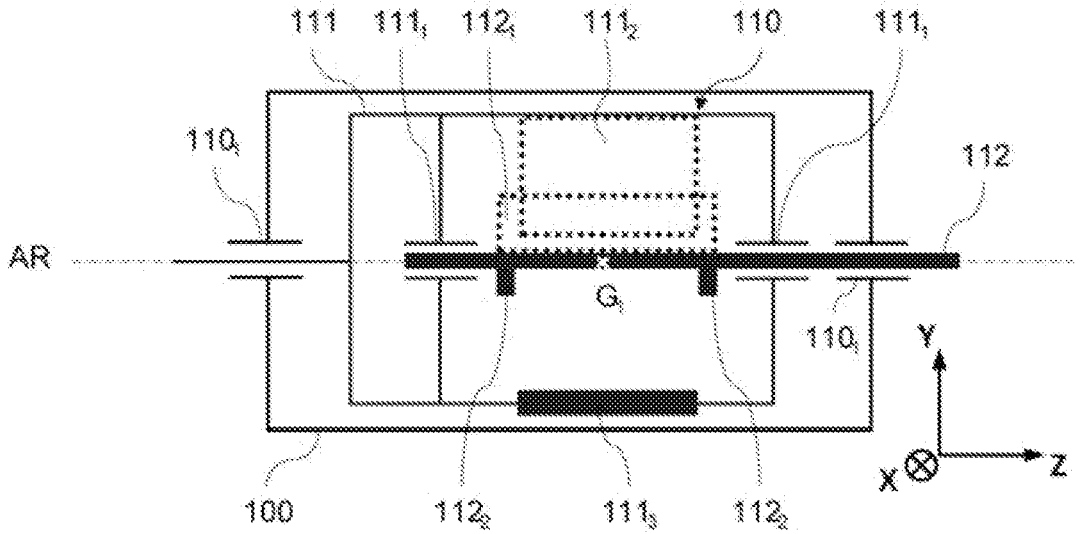
FIG. 1 is a schematic representation of a first example of a first embodiment of the proposed technique applied to an impact mechanism of the Maurer single-hammer type.
Figure 2:
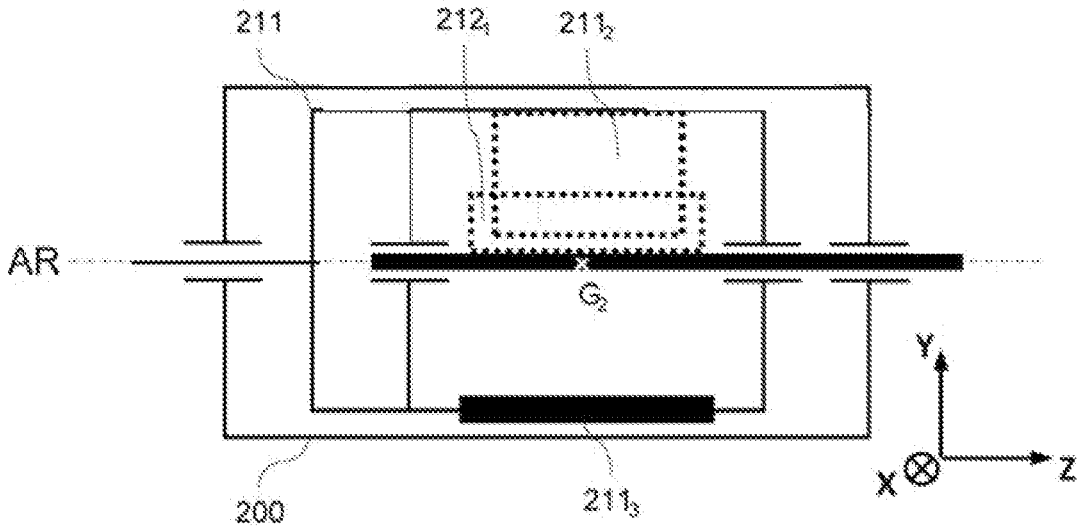
FIG. 2 is a schematic representation of a second example of a first embodiment of the proposed technique applied to a Maurer single-hammer type impact mechanism.
Figure 3:
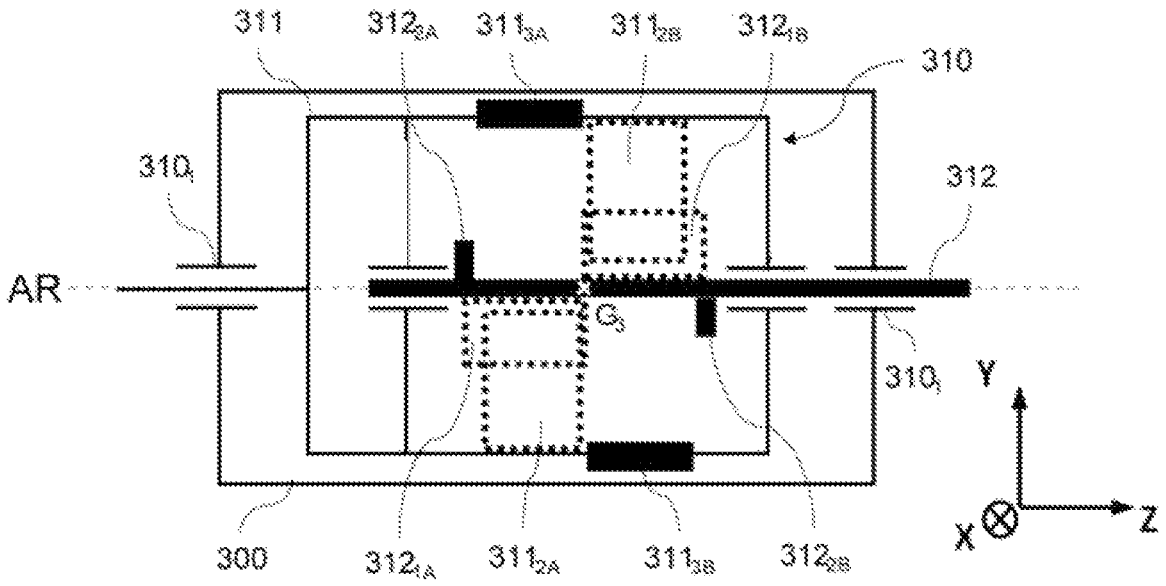
FIG. 3 is a schematic representation of a third example of a first embodiment of the proposed technique applied to a Maurer twin-hammer type impact mechanism.

FIGS. 1 to 3 are schematic representations of examples of Maurer type rebound impact mechanisms according to a first embodiment of the proposed technique.

The principle of this first embodiment consists of the use, in the impact mechanism, of one or more counterweights forming the anti-vibration means and being configured so that, during an impact, the center of gravity of the impact mechanism is positioned appreciably on its rotational axis and so that the rotational of the impact mechanism is appreciably one of its main axes of inertia.

More specifically, the impact mechanism comprises at least one counterweight that is diametrically opposite, i.e., positioned at 180°, to the striker element, relatively to the rotational axis of the impact mechanism.

The counterweight and the striker element are at least partially disposed in a same plane transversal to the rotational axis of the impact mechanism (the plane normal to this rotational axis).

The use of such counterweights is a simple and efficacious solution for reducing or even eliminating the level of vibrations perceived by the user.

FIG. 1 illustrates a first example of the first embodiment of the proposed technique applied to a Maurer single-hammer type rebound impact mechanism.

Classically, a Maurer single-hammer type rebound impact mechanism 110, disposed in an X, Y, Z referential system comprises a cage 111 within which a square drive 112 is mounted rotationally mobile, by means of the holding portion $\mathbf{111}_1$.

The Maurer single-hammer type rebound impact mechanism 110 is furthermore mounted so as to be rotationally mobile, by means of bearings $\mathbf{110}_1$, within the casing 100 of the impact wrench.

The cage 111 of the Maurer single-hammer type rebound impact mechanism 110 is intended to be driven in rotation by a motor (which is not visible).

The motor, the cage 111 and the square drive 112 are coaxial along a rotational axis AR oriented along the Z axis of the referential system.

The cage 111 is equipped with a striker system comprising a striker element $\mathbf{111}_2$ presenting a strike surface intended to be brought into collision against a strike reception surface belonging to a strike reception element $\mathbf{112}_1$ borne by the square drive 112.

More specifically, the striker element $\mathbf{111}_2$ is mobile in a plane radial to the rotational axis AR, i.e., in a plane oriented along the axes X, Y (perpendicular to the axis Z), so that it can take the following positions:

- a disengaged position in which the striker element $\mathbf{111}_2$ can rotate without coming into contact with the square drive 112, and
- an engaged position in which the strike surface of the striker element $\mathbf{111}_2$ comes into contact with the strike reception surface of the strike reception element $\mathbf{112}_1$.

In accordance with the first embodiment of the proposed technique, the Maurer single-hammer type rebound impact mechanism 110 comprises several counterweights $\mathbf{111}_3$, $\mathbf{112}_2$ configured so that, during an impact, the center of gravity $G_1$ of the Maurer single-hammer type rebound impact mechanism 110 is positioned on its rotational axis AR and so that the rotational axis AR of the impact mechanism is one of its main axes of inertia Z.

In this sense, the cage 111 bears a first counterweight $\mathbf{111}_3$ configured so that, when there is an impact, it brings the center of gravity of the cage 111 and of the striker element $\mathbf{111}_2$ to the rotational axis AR and so that this rotational axis is one of its main axes of inertia.

To this end, the first counterweight $\mathbf{111}_3$ is configured to cancel out, by counterbalancing, the efforts radial to the rotational axis AR induced by the cage 111 and the striker element $\mathbf{111}_2$ i.e., the forces oriented along the X, Y axes of the referential system.

It must be noted that, in a Maurer single-hammer type rebound impact mechanism 110, the cage 111 by itself, i.e., without the striker element $\mathbf{111}_2$, presents a center of gravity on the rotational axis AR and that this rotational AR is one of its main inertia axes. This observation results in a simplification of the configuration of the first counterweight $\mathbf{111}_3$, namely bringing back only the center of gravity of the striker element $\mathbf{111}_2$ to the rotational axis AR and means that this rotational AR is one of its main axes of inertia.

Besides, the square drive 112 bears second counterweights $\mathbf{112}_2$ configured so that, when there is an impact, they bring back the center of gravity of the strike reception element $\mathbf{112}_1$ to the rotational axis AR and so that this rotational axis AR is one of its main axes of inertia.

To this end, the second counterweight $\mathbf{112}_2$ is configured to cancel out, by counterbalancing, the efforts radial to the rotational axis AR induced by the strike reception element $\mathbf{112}_1$, i.e., the efforts oriented along the X, Y axes of the referential system.

In the example illustrated, to cancel out the efforts radial to the rotational axis AR induced by the striker element $\mathbf{111}_2$, the first counterweight $\mathbf{111}_3$ is positioned on the cage 111 opposite the striker element $\mathbf{111}_2$ and facing it. The sizing of the first counterweight $\mathbf{111}_3$ is a function of the sizing of the striker element $\mathbf{111}_2$, and hence of the efforts radial to the rotation AR induced by of this striker element.

In addition, similarly to the first counterweight $\mathbf{111}_3$, to cancel out the efforts radial to the rotational axis AR induced by the strike reception element $\mathbf{112}_1$, the second counterweights $\mathbf{112}_2$ are positioned on the square drive 112 diametrically opposite the strike reception element $\mathbf{112}_1$. The sizing of the second counterweights $\mathbf{112}_2$ is a function of the sizing of the strike reception element $\mathbf{112}_1$, and therefore of the forces radial to the rotational axis AR induced by this element.

FIG. 2 illustrates a second example of the first embodiment of the proposed technique applied to a Maurer single-hammer type rebound impact mechanism.

This second example of an embodiment is distinguished from the first one solely by the configuration of the counterweights.

In this second example of an embodiment, the Maurer single-hammer type rebound impact mechanism 200 comprises a single counterweight $\mathbf{211}_3$ configured so that during an impact, the center of gravity G2 of the Maurer single-hammer type rebound impact mechanism is positioned on its rotational axis AR and so that the rotational axis AR of the impact mechanism is one of its main axes of inertia, the Z axis.

The single counterweight $\mathbf{211}_3$ is therefore configured so that, when there is an impact, it brings back the center of gravity of the striker element $\mathbf{211}_2$ and of the strike reception element $\mathbf{212}_1$ to the rotational axis AR and so that this rotational axis AR is one of the main axes of inertia. The single counterweight $\mathbf{211}_3$ is therefore configured to cancel out, in counterbalancing, the efforts radial to the rotational axis AR induced by the striker element $\mathbf{111}_2$ and the strike reception element $\mathbf{212}_1$, i.e., the efforts oriented along the X, Y axes of the referential system.

As illustrated, the single counterweight $\mathbf{211}_3$ is positioned on the cage 211 at 180 to the striker element $\mathbf{211}_2$ (and therefore to the strike reception element $\mathbf{212}_1$ during the impact). The sizing of the single counterweight $\mathbf{211}_3$ is a function of the sizing of the striker element $\mathbf{211}_2$ and strike reception element $\mathbf{112}_1$, and therefore the efforts radial to the rotational axis AR induced by these elements.

FIG. 3 illustrates a second example of the first embodiment of the proposed technique applied to a Maurer twin-hammer type rebound impact mechanism 300.

This third example of the embodiment is distinguished from the first one by the structure of the impact mechanism and by the configuration of the counterweights.

Classically, a Maurer twin-hammer type rebound impact mechanism is distinguished from a Maurer single-hammer type rebound impact mechanism by the implementing of two striker elements that are diametrically opposite and off-centered relatively to each other.

Thus, the Maurer twin-hammer type rebound impact mechanism 310, disposed in a X, Y, Z referential system, comprises a cage 311 with which a square drive 312 is mounted rotationally mobile, by means of a holding portion $\mathbf{311}_1$.

The Maurer twin-hammer type rebound impact mechanism 310 is furthermore mounted so as to be rotationally mobile, by means of the bearings $\mathbf{310}_1$, within the casing 300 of the impact wrench.

The cage 311 of the Maurer twin-hammer type rebound impact mechanism 310 is intended to be rotationally driven by a motor (not visible).

The motor, the cage 311 and the square drive 312 are coaxial along a rotational axis AR oriented along the axis of the reference system.

The cage 311 is equipped with a striker system comprising two striker elements $\mathbf{311}_{2A}$, $\mathbf{311}_{2B}$ situated at 180° relatively to each other and disposed in different planes radial to the rotational axis AR. Each striker element $\mathbf{311}_{2A}$, 31128 has a strike surface intended to be brought into collision against a strike reception surface belonging to a strike reception element $\mathbf{312}_{1A}$, $\mathbf{312}_{1B}$ respectively, borne by the square drive 112.

More specifically, the striker elements $\mathbf{311}_{2A}$, 31128 are mobile in planes radial to the rotational axis AR, i.e., in planes oriented along the X, Y axis (perpendicular to the Z axis), so that they can take the following positions:

- a disengaged position in which the striker element $\mathbf{311}_{2A}$, $\mathbf{311}_{2B}$ can rotate without coming into contact with the square drive 312, and
- an engaged position, in which the strike surfaces of the striker elements $\mathbf{311}_{2A}$, $\mathbf{311}_{2B}$ come into contact with the strike reception surfaces of the strike reception elements $\mathbf{312}_{1A}$, $\mathbf{312}_{1B}$ of the square drive 312.

In accordance with the first embodiment of the proposed technique, the Maurer twin-hammer type rebound impact mechanism 310 comprises several counterweights $\mathbf{311}_{3A}$, $\mathbf{311}_{3B}$, $\mathbf{312}_{2A}$, $\mathbf{312}_{2B}$ configured so that, during an impact, the center of gravity $G_3$ of the Maurer twin-hammer type rebound impact mechanism 310 is positioned on its rotational axis AR and so that the rotational axis AR of the impact mechanism is one of its main axes of inertia, the Z axis.

More specifically, the cage 111 carries two first counterweights $\mathbf{311}_{2A}$, 31128 configured, during an impact, to bring the center of gravity of the striker elements $\mathbf{311}_{2A}$, 31128 back to the rotational axis AR and configured so that this rotational axis AR is one of its main axes of inertia.

The first counterweights $\mathbf{311}_{3A}$, $\mathbf{311}_{3B}$ are configured, in counterbalancing, to cancel out the forces radial to the rotational axis AR induced by the striker elements $\mathbf{311}_{2A}$, $\mathbf{311}_{2B}$, i.e., the forces oriented along the X, Y axes of the referential system.

To this end, each striker element $\mathbf{311}_{2A}$, $\mathbf{311}_{2B}$ is associated with a first counterweights $\mathbf{311}_{3A}$, $\mathbf{311}_{3B}$, fixedly attached to the cage 311 which is diametrically opposite to it. The sizing of the first counterweights $\mathbf{311}_{3A}$, $\mathbf{311}_{3B}$ is a function of the sizing of the striker elements $\mathbf{311}_{2A}$, $\mathbf{311}_{2B}$, and therefore of the efforts radial to the rotational axis AR induced by these elements.

In addition, the square drive 312 bears two second counterweights $\mathbf{312}_{2A}$, $\mathbf{312}_{2B}$ configured so that, when there is an impact, they bring the center of gravity of the strike reception elements $\mathbf{312}_{1A}$, $\mathbf{312}_{1B}$ back to the rotational axis AR and so that this rotational axis AR is one of its main axes of inertia.

The second counterweights $\mathbf{312}_{1A}$, $\mathbf{312}_{1B}$ are configured, in counterbalancing, to cancel out the efforts radial to the rotational axis AR induced by the strike reception elements $\mathbf{312}_{1A}$, $\mathbf{312}_{1B}$, i.e., the forces oriented along the X, Y axes of the referential system.

To this end, each strike reception element $\mathbf{312}_{1A}$, $\mathbf{312}_{1B}$ is associated with the second counterweights $\mathbf{312}_{2A}$, $\mathbf{312}_{2B}$, fixedly attached to the square drive 312 which is diametrically opposite to it. The sizing of the second counterweights $\mathbf{312}_{2A}$, $\mathbf{312}_{2B}$ is a function of the sizing of the strike reception elements $\mathbf{312}_{1A}$, $\mathbf{312}_{1B}$, and therefore of the efforts radial to the rotational axis AR induced by these elements.

6.4. Description of a Second Embodiment

FIGS. 4 to 11 are representations of several embodiments of a Maurer type impact mechanism according to a second embodiment of the proposed technique.

The principle of this second embodiment of the proposed technique consists in proposing an impact mechanism comprising a striker system equipped with at least three striker elements, having identical cross-sections disposed so that, during the impact in particular, the center of gravity of the impact mechanism is positioned on its rotational axis and so that the rotational axis of the impact mechanism is one of its main axes of inertia.

The inventor of the present application has observed that, when striker elements have identical cross-sections, the inertia and the relative mass of each striker element are solely proportional to its thickness. This observation stems from the fact that, when disposed in a cage, the striker elements have the same radial position of their center of gravity at each point in time.

This second embodiment is therefore based on obtaining anti-vibration means by means of a special arrangement of at least three striker elements with identical cross-sections.

More specifically, this particular layout consists in positioning two lateral striker elements having identical thickness values, on either side, along the rotational axis of the impact mechanism (i.e., along the rotational axis of the impact mechanism), of a central striker element having a total value of thickness equal to twice the value of thickness of a lateral striker element. In addition, the at least one central striker element is diametrically opposite to the two lateral striker elements relatively to the rotational axis of the impact mechanism.

This second embodiment further reduces the level of vibrations perceived by the user. Indeed, this second embodiment reduces or even eliminates the level of vibration perceived by the user during the different phases of operation of the impact mechanism.

This is because, according to this embodiment, the rotational axis of the impact mechanism is permanently one of the main axes of inertia of the impact mechanism. For example, the central striker element comprises several juxtaposed elementary central striker elements, at least two for example, of which the sum of the thickness along the axis of the elementary central striker elements defines the total value of thickness.

Figure 4:
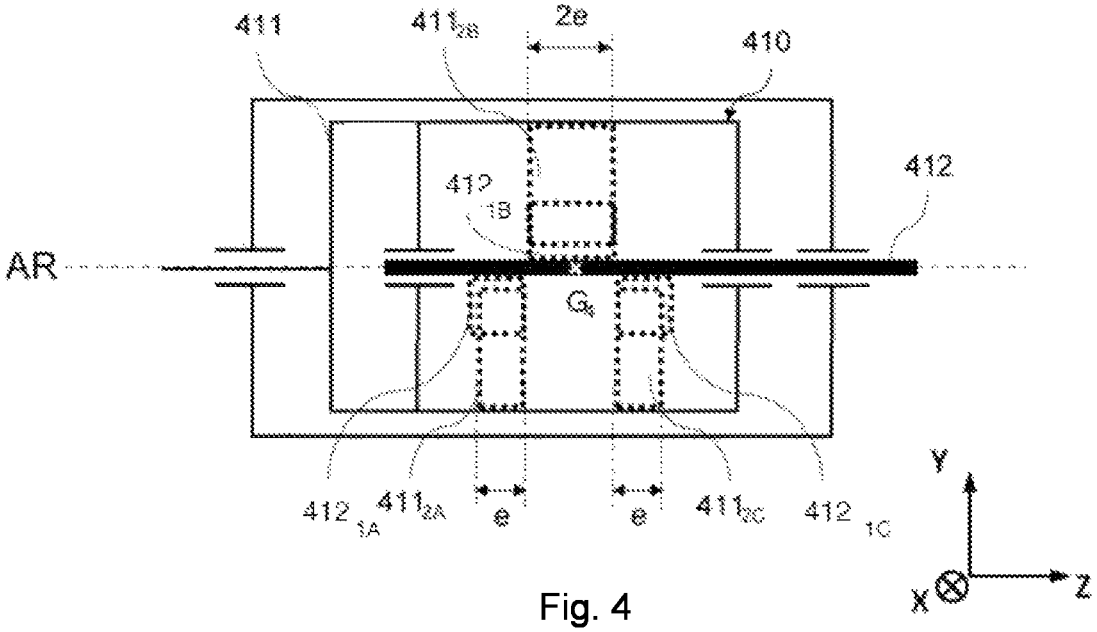
FIG. 4 is a schematic representation of a first example of a second embodiment of the proposed technique applied to a Maurer type impact mechanism.

FIG. 4 is a schematic representation of a first example of the second embodiment of the proposed technique applied to a Maurer type rebound impact mechanism.

Classically, the Maurer type rebound impact mechanism 410 disposed in an X, Y, Z referential comprises a cage 411 within which a square drive 412 is mounted rotationally mobile, by means of a holding portion $\mathbf{411}_1$, on a square drive 412.

The Maurer type rebound impact mechanism 410 is further mounted to be mobile in rotation, by means of bearings $\mathbf{410}_1$, within the casing 400 of the impact wrench.

The cage 411 of the mechanism 410 is intended to be driven in rotation by a motor (not shown). The motor, the cage 411 and the square drive 412 are coaxial along a rotational axis AR oriented along the Z axis of the referential system.

In accordance with the second embodiment of the proposed technique, the impact mechanism 410 or more specifically the cage 411 bears three striker elements $\mathbf{411}_{2A}$, $\mathbf{411}_{2B}$, $\mathbf{411}_{2C}$, having identical cross-sections, disposed so that the center of gravity $G_4$ of the impact mechanism 410 is positioned on its rotational axis AR, and so that the rotational axis AR of the impact mechanism is one of its main axes of inertia.

To this end, the impact mechanism 410 has two identical lateral striker elements $\mathbf{411}_{2A}$, $\mathbf{411}_{2C}$ disposed, along the rotational axis AR of the impact mechanism, on either side of a central striker element $\mathbf{411}_{2B}$ constituted by a single elementary central striker element. The three striker elements $\mathbf{411}_{2A}$, $\mathbf{411}_{2B}$, $\mathbf{411}_{2C}$ are disposed in three distinct planes radial to the rotational axis AR.

In addition, the central striker element $\mathbf{411}_{2B}$ is opposite by 180° to the two lateral striker elements $\mathbf{411}_{2A}$, $\mathbf{411}_{2C}$ relatively to the rotational axis AR of the impact mechanism.

Besides, each lateral striker element $\mathbf{411}_{2A}$, $\mathbf{411}_{2C}$ has a first value of thickness e. The central striker element $\mathbf{411}_{2B}$ has a second value of thickness 2*e*. The second value of thickness 2*e* is equal to twice the first value of thickness e.

Similarly, the square drive 412 bears three strike reception elements $\mathbf{412}_{1A}$, $\mathbf{412}_{1B}$, $\mathbf{412}_{1C}$ configured to cooperate with the three striker elements $\mathbf{411}_{2A}$, $\mathbf{411}_{2B}$, $\mathbf{411}_{2C}$ respectively.

More specifically, the striker elements $\mathbf{411}_{2A}$, $\mathbf{411}_{2B}$, $\mathbf{411}_{2C}$ are mobile in planes radial to the rotational axis AR, also called transversal and/or normal planes, i.e., planes oriented along the X, Y axes (perpendicular to the Z axis) so that they can take the following positions:

- a disengaged position, in which the striker elements $\mathbf{411}_{2A}$, $\mathbf{411}_{2B}$, $\mathbf{411}_{2C}$ can rotate without coming into contact with the square drive 412, and
- an engaged position, in which the strike surface of the striker elements $\mathbf{411}_{2A}$, $\mathbf{411}_{2B}$, $\mathbf{411}_{2C}$ come into contact with the strike reception surfaces of the strike reception elements $\mathbf{412}_{1A}$, $\mathbf{412}_{1B}$, $\mathbf{412}_{1C}$ of the square drive 412.

Figure 5:
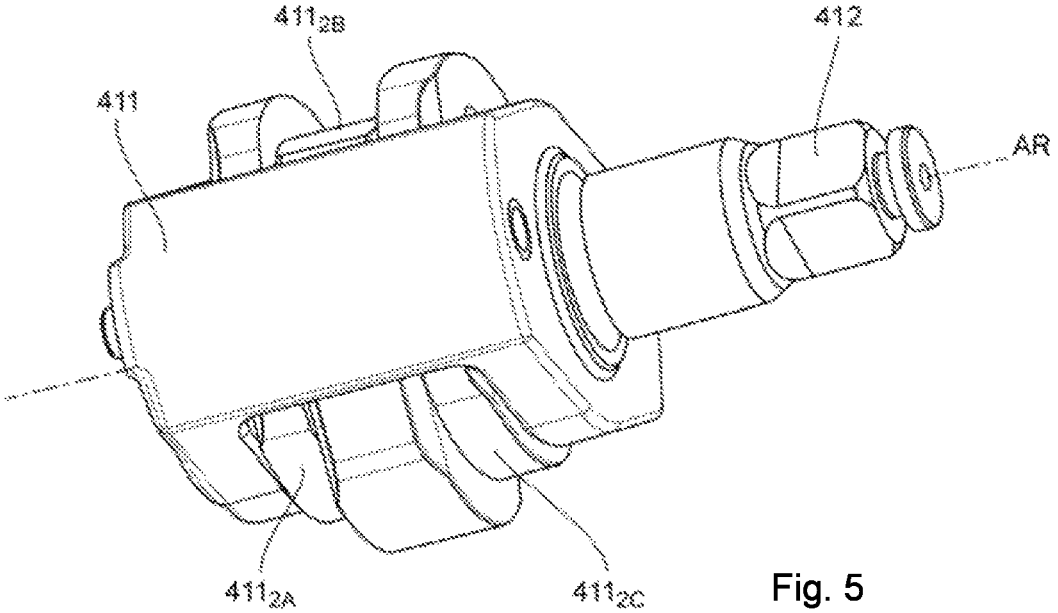
FIG. 5 is a view in perspective of a modeling of the schematic representation of FIG. 4.

FIG. 5 is a view in perspective or three-quarter view of a modelling of a Maurer type rebound impact mechanism according to the first example of the second embodiment described with reference to FIG. 4.

Figure 6:
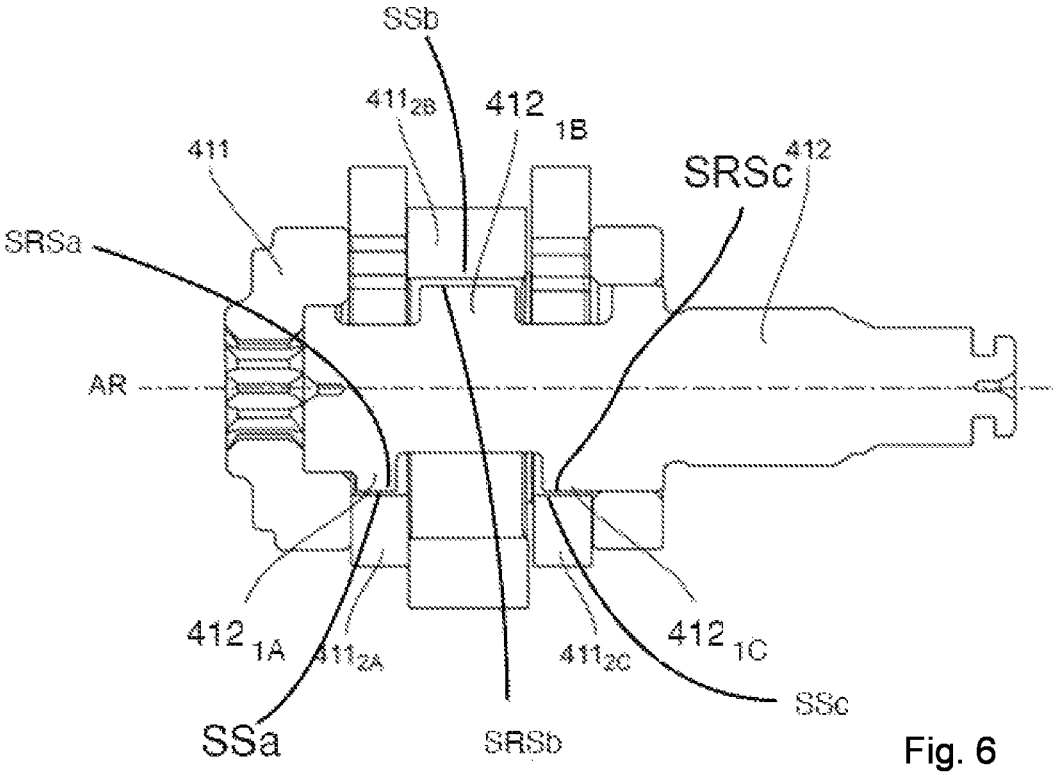
FIG. 6 is a longitudinal sectional view of the modeling of FIG. 5.

FIG. 6 is a longitudinal sectional view of the modelling of a Maurer type rebound impact mechanism of FIG. 5.

Figure 7:
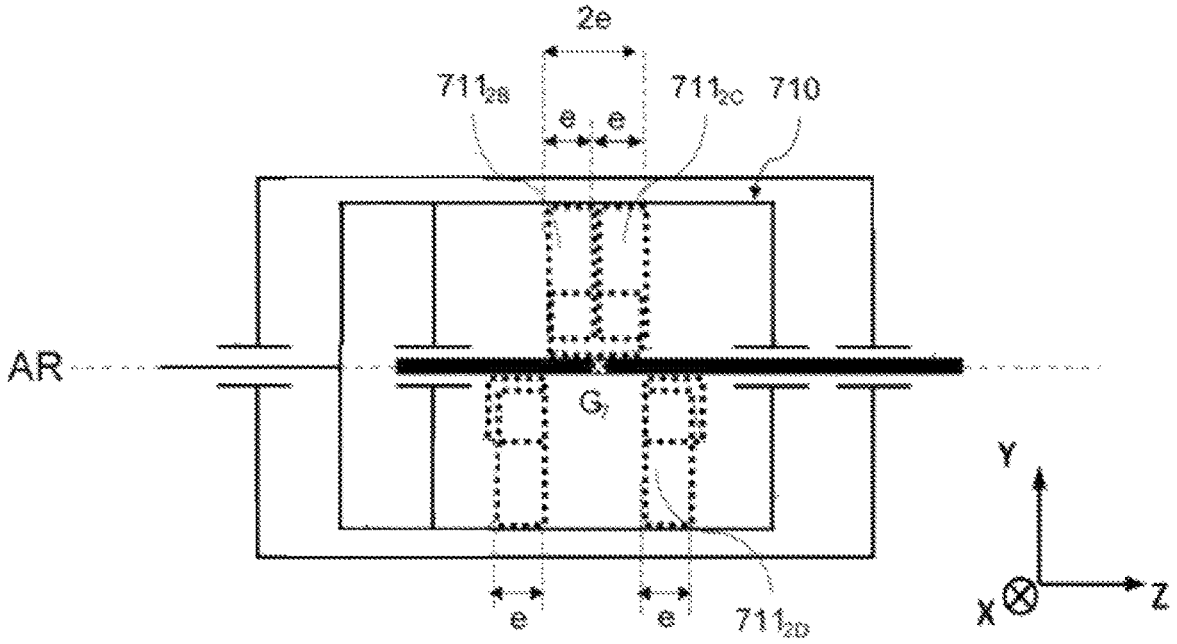
FIG. 7 is a schematic representation of a second example of the second embodiment of the proposed technique applied to a Maurer type impact mechanism.

FIG. 7 illustrates a second embodiment of the proposed technique applied to a Maurer type rebound impact mechanism.

This second embodiment is distinguished from the first one by the number and structure of the striker elements.

In this second exemplary embodiment, the impact mechanism 710 comprises four striker elements $\mathbf{711}_{2A}$ a $\mathbf{711}_{2D}$ having identical cross-sections and values of thickness.

Thus, in order that the center of gravity $G_7$ of the impact mechanism 710 be positioned on its rotational axis AR and in order that the rotational axis AR of the impact mechanism 710 be one of its main axes of inertia, two juxtaposed elementary striker elements $\mathbf{711}_{2A}$, $\mathbf{711}_{2D}$ are positioned on either side, along the rotational axis AR of the impact mechanism, of a central striker element constituted by two elementary central striker elements $\mathbf{711}_{2B}$, $\mathbf{711}_{2C}$.

The four striker elements $\mathbf{711}_{2A}$ to $\mathbf{711}_{2D}$ have an identical value of thickness, the total value of thickness of the central striker elements $\mathbf{711}_{2A}$, $\mathbf{711}_{2D}$ being therefore equal to twice the value of thickness of each lateral striker element $\mathbf{711}_{2A}$, $\mathbf{711}_{2D}$.

The identical implementation of four striker elements $\mathbf{711}_{2A}$ to $\mathbf{711}_{2D}$ minimizes the cost of manufacture of an impact wrench according to the proposed technique.

Figure 8:
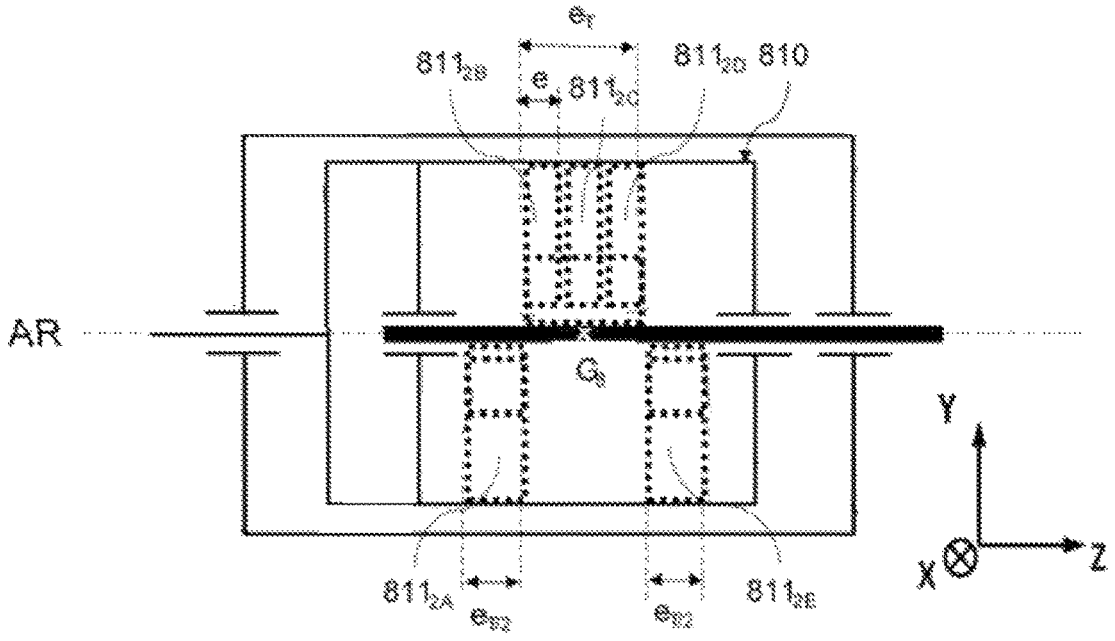
FIG. 8 is a schematic representation of a third example of the second embodiment of the proposed technique applied to a Maurer type impact mechanism.
Figure 9:
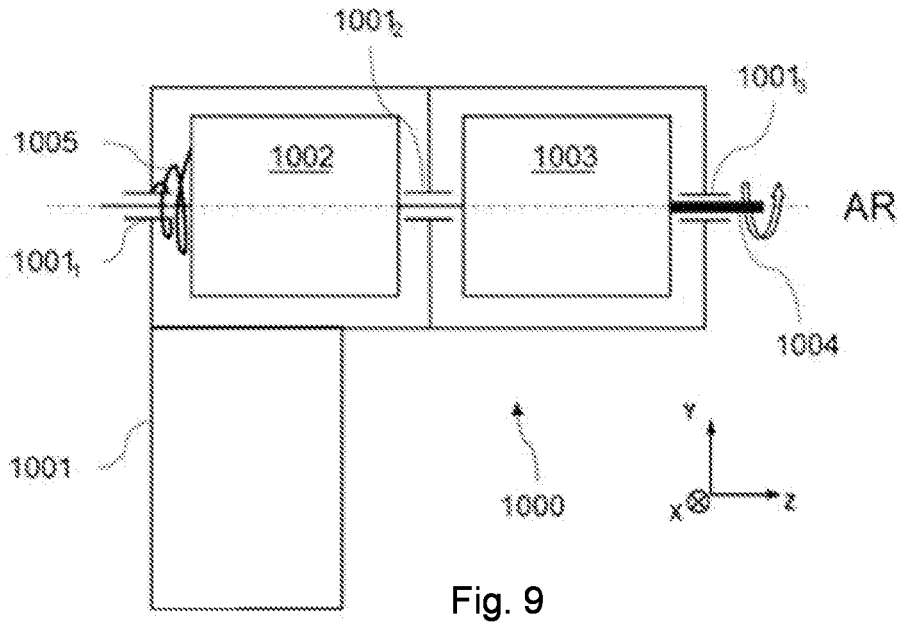
Fig. 9 (Prior Art)
FIG. 9 is a schematic representation of the mechanical system of a screwing/unscrewing device with impact mechanism according to the prior art.

FIG. 8 illustrates a third example of the second embodiment of the proposed technique applied to a Maurer type rebound impact mechanism.

This third example of an embodiment is distinguished from the first by the number and structure of the striker elements.

In this third example of an embodiment, the impact mechanism 810 comprises five striker elements $\mathbf{811}_{2A}$ to $\mathbf{811}_{2E}$ namely:

- a central striker element constituted by three juxtaposed, elementary central striker elements $\mathbf{811}_{2B}$ to $\mathbf{811}_{2D}$, respectively having a first value of thickness e, defining a total value of thickness $e_T$ corresponding to the sum of the three values of thickness of the three central elementary central striker elements $\mathbf{811}_{2B}$ to $\mathbf{811}_{2D}$,
- two identical lateral striker elements $\mathbf{811}_{2A}$, $\mathbf{811}_{2E}$ respectively having a second value of thickness $e_{T/2}$ corresponding to half of the total value of thickness defined by the plurality of central striker elements $\mathbf{811}_{2B}$ to $\mathbf{811}_{2D}$.

Thus, the principle of the second embodiment of the proposed technique is complied with and enables the center of gravity G of the impact mechanism to be positioned on its rotational axis and the rotational axis of the impact mechanism to be one of its main axes of inertia.

Thus, it can be seen that the proposed technique is versatile and can be applied to various types of impact mechanisms.

6.5. Various Aspects

In the light of the prerequisites described here above, it can be seen that the proposed technique is not intended to be applied to impact wrenches comprising impact mechanisms with components mobile in translation along the rotational axis of the square drive, such as "pin clutch" or "two jaws" type mechanisms in particular. Also, it is not the purpose of the proposed technique to be applied to impact wrenches comprising impact mechanisms that generate an impact more than once per turn of the square drive, such as the "double rocking dog" type mechanism for example, which works on a half-turn of the square drive between each impact.

The proposed technique is nevertheless intended to be applied to impact wrenches implementing the Maurer single-hammer, Maurer twin-hammer, and single rocking dog mechanisms.

Besides, the proposed technique has been described and illustrated in choosing a theoretical model of the different components constituting the impact wrench: non-deformable bodies, non-existence of clearances in the links, etc. These theoretical modifications eliminate the vibrations perceived by the user in proposing an impact mechanism configured so that, at least during the impact, its center of gravity G is positioned on its rotational axis and so that the rotational axis follows one of the main axes of inertia.

However, it can be the case that this theoretical modelling is not representative of the real structure of the components. For example, certain components can show deformations according to the level of wear and tear of these components.

Thus, it is appropriate to tend towards this theoretical configuration by the implementing of an impact mechanism configured so that, during the impact, its center of gravity G is appreciably positioned on its rotational axis and so that the rotational axis is appreciably one of its main axes of inertia.

Tending towards this theoretical configuration makes it possible to reduce the transversal efforts to portions of the casing holding the mechanical system (bearing surfaces of the casing), when the resultant impact, between the striker system and the square drive tends towards a torque directed along the rotational axis. This leads, if not to an elimination, to a major reduction in the level of vibrations perceived by the user.

To this end, those skilled in the art could clearly adapt the shapes, sizes and materials of the components of the impact mechanism such as the square drive, the hammers, the counterweights in particular, to make it compliant with the proposed technique.

It can be therefore be seen that the proposed technique is not limited to the embodiments described here above and provided purely by way of an example. They encompass different modifications, alternative forms and other variants that could be envisaged by those skilled in the art in the context of the problems and issues posed and in particular they include all combinations of the different embodiments described here above that could be taken separately or in association.

An exemplary embodiment of the present disclosure is aimed especially at providing an efficient solution to at least some of the different problems discussed above.

At least one embodiment optimizes the impact wrenches with impact mechanism.

In particular, at least one embodiment provides an impact wrenches with impact mechanism which, during the phase of impact in particular, reduces or even eliminates the level of vibrations perceived by the user of such a wrench.

In particular, at least one embodiment provides such an impact wrench that is simple of design and/or simple to implement.

At least one embodiment provides an impact wrench of this kind that is lightweight and/or compact.

The invention claimed is:

1. A tool comprising:

a Maurer type rebound impact mechanism configured to be driven along a rotational axis and held fixed in translation along said rotational axis, said impact mechanism comprising:

a striker system rotationally driven along said rotational axis, comprising at least one striker element, a square drive comprising at least one strike reception element, said at least one striker element-being configured to come into contact with said at least one strike reception element to generate an impact torque, said striker system being configured to be driven in rotation, along said rotational axis, on at least 200° before impact, an anti-vibration element configured so that, at least during an impact:

the center of gravity of the impact mechanism is positioned on said rotational axis, and said rotational axis of the impact mechanism is on a main axis of inertia of the impact mechanism.

2. The tool according to claim 1, wherein the at least one striker element comprises a strike surface and the at least one strike reception element comprises a strike reception surface, and the at least one striker element is configured to alternate cyclically between:

a disengaged position in which the at least one striker element is not in contact with the at least one strike reception element, and an engaged position, in which said strike surface of the at least one striker element is in contact with said strike reception surface of the at least one strike reception element so as to generate said impact torque.

3. The tool according to claim 1, wherein said anti-vibration element is configured so that:

the center of gravity of the impact mechanism is permanently situated on the rotational axis of the impact mechanism, and said rotational axis of the impact mechanism is permanently a main axis of inertia of the impact mechanism.

4. The tool according to claim 3, wherein said striker system comprises at least three striker elements having identical cross-sections in a plane essentially perpendicular to said rotational axis, and in that said at least three striker elements constitute said anti-vibration element.

5. The tool according to claim 4, wherein said striker system comprises, disposed along the rotational axis of said impact mechanism:

at least one central striker element having, along the rotational axis (AR) of said impact mechanism, a total value of thickness, and two lateral striker elements disposed on either side of said at least one central striker element, along the rotational axis of the impact mechanism, the lateral striker elements having respectively values of thickness equal to half of the value of the total thickness of said at least one central striker element along said rotational axis and said at least one central striker element is disposed so as to be diametrically opposite to said lateral striker elements relatively to the rotational axis of the impact mechanism.

6. The tool according to claim 5, wherein said central striker element comprises at least two juxtaposed elementary central striker elements, the sum of the thicknesses along said axis of said elementary central striker elements being equal to said total value of thickness.

7. The tool according to claim 1, wherein said anti-vibration element comprises at least one counterweight disposed in the impact mechanism, said at least one counterweight being configured to cancel out forces that are radial to said rotational axis induced by said at least one striker element and by said at least one strike reception element.

8. The tool according to claim 7, wherein said at least one counterweight is disposed in the impact mechanism, said at least one counterweight being positioned at 180°, along the rotational axis of the impact mechanism, to said at least one striker element and to said at least one strike reception element.

9. The tool according to claim 1, wherein the impact mechanism belongs to the group consisting of a Maurer Single Hammer, a Maurer Twin Hammer, and a Single Rocking dog.

* * * * *